United States Patent [19]

Whitesides et al.

[11] 4,328,683

[45] May 11, 1982

[54] WATER HEATING SYSTEM

[75] Inventors: Robert B. Whitesides, Murrysville; Ronald A. Holt, Export, both of Pa.

[73] Assignee: Aluminum Company of America, Pittsburgh, Pa.

[21] Appl. No.: 224,146

[22] Filed: Jan. 12, 1981

[51] Int. Cl.[3] ..... F25B 27/02

[52] U.S. Cl. ..... 62/238.6; 62/324.5; 237/2 B

[58] Field of Search ..... 62/238.6, 324.5; 237/2 B

[56] References Cited

U.S. PATENT DOCUMENTS

| | | | |
|---|---|---|---|
| 2,125,842 | 8/1938 | Eggleston | 62/238.6 |
| 4,168,745 | 9/1979 | Lastinger | 62/238.6 |
| 4,173,872 | 11/1979 | Amthor, Jr. | 62/238.6 |

FOREIGN PATENT DOCUMENTS

| | | | |
|---|---|---|---|
| 880093 | 10/1961 | United Kingdom | 62/238.6 |

*Primary Examiner*—Lloyd L. King
*Attorney, Agent, or Firm*—Elroy Strickland

[57] ABSTRACT

A container construction and combination in which a container for confining water is provided with a metal heat exchanger disposed vertically within the container. The heat exchanger is comprised of inner and outer tube structures joined together in heat exchange relationship by fins extending between the tube structures, the fins having cross sections sized to conduct all the heat of a refrigerant in the inner tube structure to water located adjacent the outer tube structure. In addition, the outer tube structure has outwardly directed fins extending in a vertical direction within the container. The heat exchanger has upper and lower ends within the container, and means are provided for connecting the upper end of the heat exchanger to a source of heated refrigerant through an upper opening in the wall of the container, the refrigerant being vaporized when heated, and condensed when cooled in the heat exchanger. The vertical disposition of the heat exchanger permits the force of gravity to remove condensed refrigerant from the heat exchanger. Means are provided for returning condensed refrigerant to the source of heated refrigerant through a lower opening in the wall of the container, and means are provided to free the combination of galvanic action when water is present in the container.

8 Claims, 6 Drawing Figures

WATER HEATING SYSTEM

BACKGROUND OF THE INVENTION

The present invention relates generally to the heating of water for commercial and/or home use, and particularly to a water heating system that is free of the corrosive effects of galvanic action, thereby providing the system with a long life.

A substantial amount of art exists which discloses the use of heat sources, such as solar heaters, to heat water within a container or tank structure, the heat source being connected in fluid communication with a heat exchanger (condenser) located within the container. This art includes the use of ordinary glass-lined, hot water tanks having a heat exchange unit within the tank structure, such as shown in U.S. Pat. No. 4,173,872 to Amthor.

However, we have discovered that in using such hot water tanks, which tanks are made from steel, in combination with a non-ferrous heat exchanger, such as a copper condenser, that galvanic processes occur between the steel of the tank and the copper of the condenser, which result in corrosive attack and penetration of the wall of the tank. This is particularly true when there is a small pinhole-type of perforation in the glass lining of the tank, such that the relatively large copper heat exchanger "sees" a very tiny steel element. The result of this is a highly concentrated attack on the small area of steel behind the pinhole in the glass.

In addition, we have found that the use of sacrificial anodes disposed within the tank and the water within the tank are not sufficient to prevent rapid corrosion and deterioration of the tank wall. What is therefore needed is the outright prevention of such galvanic action.

BRIEF SUMMARY OF THE INVENTION

The present invention solves the galvanic problem by using dielectric, insulating bushings in openings provided in the wall of a metal tank or container to thereby insulate the heat exchanger and other metal components associated with the heat exchanger and tank from the metal wall of the tank. In addition, galvanic action problems can be solved by the use of a tank structure made of plastic or fiberglass materials. In this manner, no galvanic action can take place between the metal of the heat exchanger and the tank since the tank itself is an insulated structure.

In order to make the use of heat sources sufficiently efficient and therefore economically viable for the ordinary household and for commercial use, we have found that certain structures and their orientation within the container or tank are required. For example, by placing the heat exchanger in a substantially vertical position within the tank, any unvaporized, i.e. any liquid "slugs" of a vaporizable refrigerant entering the heat exchanger will flow naturally from the heat exchanger by the force of gravity for return to the source of heat. Similarly, by placing the heat exchanger vertically within the tank and providing the heat exchanger with fins that extend vertically within the tank, convection currents within the tank that move the water past the heat exchanger are not impeded by the heat exchange and fin structures such that efficiency in the heat exchange process is enhanced. In using leak detection tube means, as shown in the above Amthor patent, it is also desirable to provide a fin structure between the inner and outer tubes that conveys all of the heat of the refrigerant within the inner tube to the outer tube and thus to the water to be heated that is located around the outer tube. In this manner, one obtains the benefits of leak detection while simultaneously providing maximum transfer of heat. One of the surprising results of the present invention is the ability to convey as much heat through a double wall tube structure as that conveyable through the wall of a single wall tube, which wall is in direct contact with both the inner heated refrigerant and the outside water.

THE DRAWINGS

The objectives and advantages of the present invention will be best understood from consideration of the following detailed description and the accompanying drawings, in which.

PREFERRED EMBODIMENTS OF THE INVENTION

Figure 1:
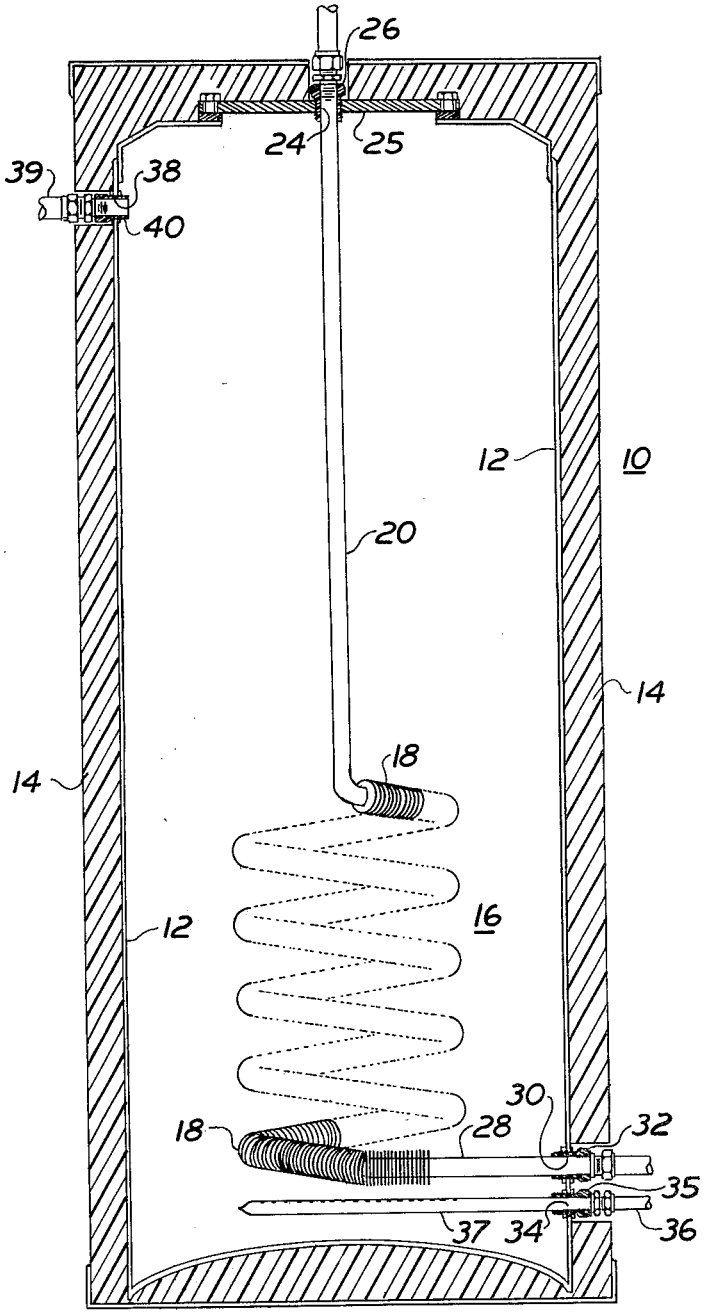
FIG. 1 is a vertical section of an insulated, glass-lined water storage tank having a heat exchange unit vertically disposed within the tank.

Referring now to the drawings, FIG. 1 thereof shows a tank or container 10 having a wall 12 for containing and storing water within the confines of the wall and tank. If the tank is a ferrous structure, the inside surface of wall 12 is provided with a thin coating of glass (not shown) to protect the wall from rust and general deterioration. The outside of the container is surrounded by a layer of insulation 14 to limit heat loss through the glass-metal wall of the tank. If the wall 12 of tank 10 is an insulating material, insulating layer 14 may or may not be required, depending upon the particular material of the wall and tank. In addition, the configuration of tank 10 need not be that of FIGS. 1 and 2. Rather, the tank can be of any shape and be positioned in any suitable manner. The tank, of course, must have an inside dimension sufficient to receive and contain a heat exchange means, as presently to be described.

Within tank 10 is a heat exchanging means 16 in the form of a helical tube structure vertically disposed in the lower region of the tank. On the outside surface of the helical tube structure are outwardly directed fins 18, which also extend in a vertical direction within the tank. For purposes of clarity, the major extent of the helical tube structure is shown without fins in the depiction of FIG. 1.

Figure 6:
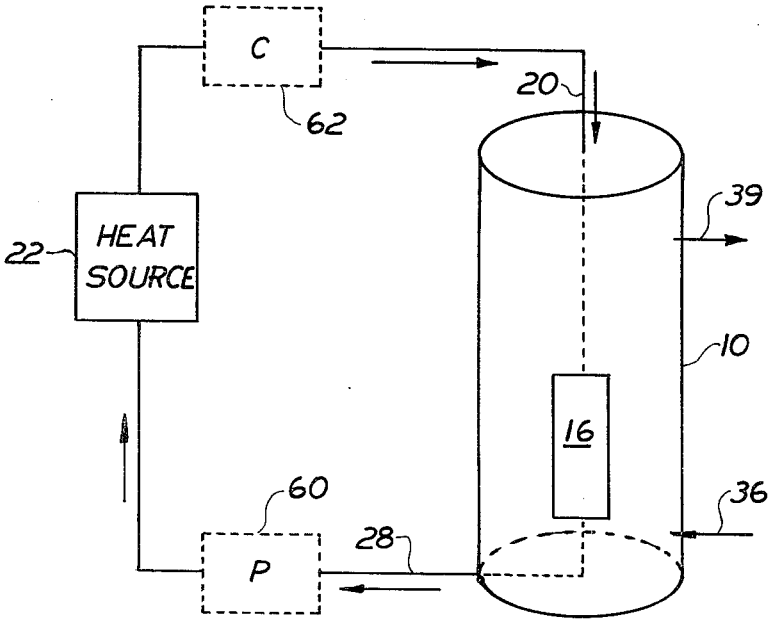
FIG. 6 is a schematic representation of the system of the invention.

An integral straight tube portion 20 connects the upper end of helical tube structure 16 to a source of heat 22 (see FIG. 6). Refrigerant is vaporized at the heat source 22 and eventually condensed in the heat exchanger 16 and hence its latent heat of condensation provides the basic heating mechanism. Suitable refrigerants include organic working fluids such as Freon. Tube portion 20 extends through an opening 24 provided in an upper wall portion and removable section 25 of the tank and through an insulating bushing 26 located in the opening, if the material of the tank wall 12 is metal.

Similarly, the lower end of heat exchanger 16 is connected to heat source 22 (and at a location opposite of the connection with tube 20) via a tube portion 28 extending through an opening 30 in the lower wall of tank 10 and through an insulating bushing 32 disposed in opening 30. Tube portion 28, like that of 20, is an integral extension of helical tube structure 16, without fins 18.

Figure 2:
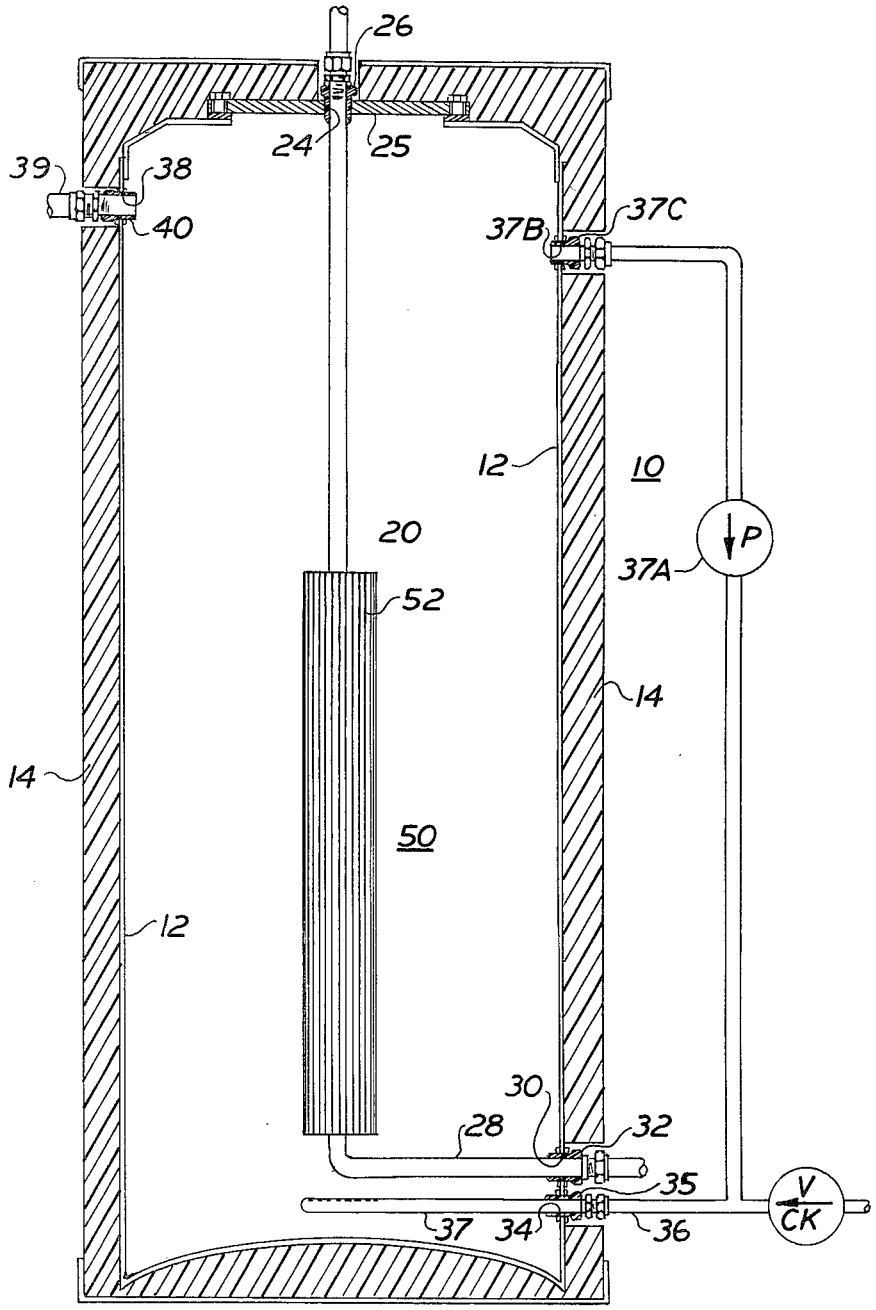
FIG. 2 shows the same tank structure but with a different type of heat exchange unit disposed vertically within the tank.

Another opening 34 is provided in the wall of tank 10 for the purpose of admitting water to the tank to be heated. In FIGS. 1 and 2 this opening is shown in the lower portion of the tank, though the entry of relatively cold water into the tank can take place at any appropriate location. And again, if the wall of the tank is metal, opening 34 is provided with an insulating bushing 35 to separate a tube or pipe 36, supplying cold water to the tank, from the tank wall.

To improve convection movement of the water in the tank, pipe 36 is shown connected to a manifold device 37 in FIGS. 1 and 2, through which water is pumped by a pump means 37A from the upper region of the tank, manifold device 37 also being insulated from tank wall 12 by a bushing 34. Such a pump and manifold means require an additional opening 37B and bushing 37C in the tank wall (FIG. 2).

In an upper side wall portion of tank 10 is provided another opening 38, and a conduit 39, for withdrawing heated water from the tank. Again, in this opening is disposed an insulating bushing 40, if the wall of the tank is metal, that electrically separates 39 from the wall of tank 10.

If tank 10 is an ordinary hot water storage tank using electrical heating elements to heat water in the tank, openings are provided in wall 12 of such a tank for the insertion of the electrical elements and for the connection of pipes to admit and remove water. The above insulating bushings (26, 32, 35 and 40) are inserted in these openings. The outside diameter of each bushing is sized to fit its respective opening (24, 30, 34 or 38) and is secured therein in a water-tight manner. The heat exchanger 16 or 50 is disposed in tank or container 10 through the upper wall thereof, i.e. upper wall portion 25 is a removable plate section for this purpose. The lower tube extension 28 of the heat exchanger has a length slightly less than the inside diameter of the tank such that 28 can be inserted through the opening of 25 and lowered into the tank to the level of opening 30 and bushing 32 provided in the side wall of the tank. 28 is then aligned with 30 and 32, and the heat exchanger moved toward the center of the tank, tube 28 thereby entering the opening of bushing 32. The size of the opening in bushing 32 is such that tube 28 is easily accepted therein, and to extend therethrough, the greater size of the bushing leaving a space between the bushing and tube.

With 28 in opening 30, plate section 25 with bushing 26 is slipped over tube extension 20, with the tube extension passing through the bushing. Tube extensions 20 and 28 are now ready to be sealed in the bushings in a water-tight manner.

Figure 4:
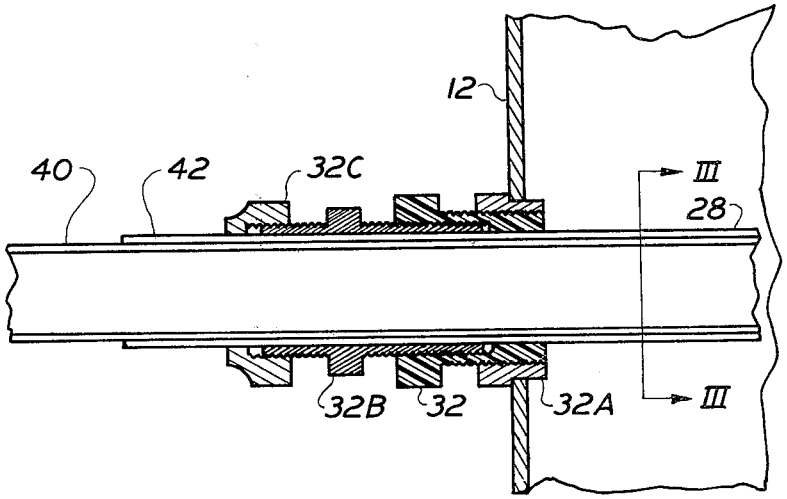
FIG. 4 is a longitudinal section of the double wall tube of FIG. 3 shown extending through the wall of the tank structure of FIGS. 1 and 2.

The tubes disposed in the openings provided in the wall of tank 12 can be sealed therein in a variety of ways. FIG. 4 of the drawings shows one such way, using tube extension 28 and bushing 32 as the example. After tube 28 is inserted through tank wall opening 30, and through a threaded metal spud 32A located in opening 30, as shown in FIG. 4, a Teflon bushing 32, as shown in FIG. 4, is threaded into the spud to fill the space between the tube and spud. The inside diameter of the spud is threaded to receive outside diameter threads of Teflon bushing 32. The inside diameter of 32 is also provided with threads to receive a metal bushing 32B having outside diameter threads. A nut 32C, capable of swaging bushing 32B against the outside surface of tube 28, is threaded on the exposed end of 32B to complete the seal of tube 28 in wall 12 of the tank in a water-tight manner. The combination of 32, 32B and 32C is given by way of example only, as other means can be employed to seal the tubing of the figures in the bushings of the figures.

The dielectric bushings 26, 32, 35 and 40 should extend along their respective tube sections inside tank 10 a distance sufficient to prevent the leakage of electrical current in the water in tank 10. In this manner, the dielectric properties of the bushings will insulate and thereby prevent current flow between the metal of the tank and the metal of the tubes and heat exchanger. With such prevention of current flow, galvanic attack on the metal of the tank is prevented.

Figure 3:
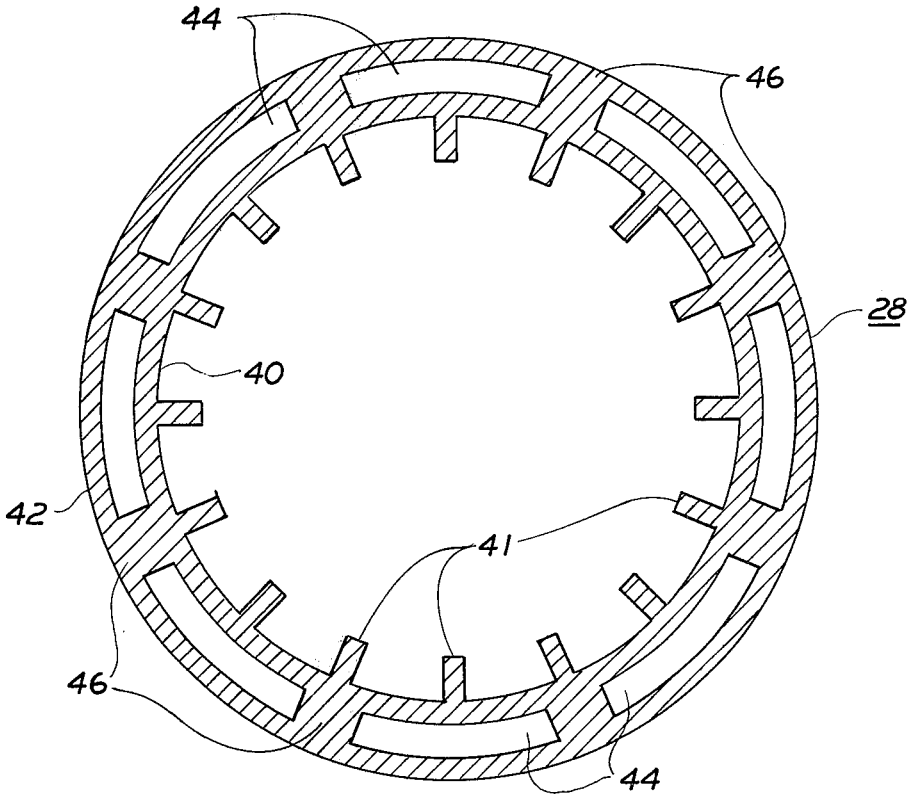
FIG. 3 is a cross sectional view of a double wall tube structure taken along lines III—III in FIG. 4 and employable in the heat exchange units of both FIGS. 1 and 2.

FIG. 3 shows a cross section of the tube structure of heat exchanger 16 and the extensions 20 and 28 of 16 extending through the wall of tank 10, as shown in FIG. 4. More particularly, referring to FIG. 3, the heat exchanger is comprised of a first tube 40, having inwardly directed fins 41, all located within a second tube 42, of a diameter larger than 40, to provide an annular space 44. The annular space, however, is partially occupied by fins 46 that are in intimate physical contact with the two tubes. The space, or more correctly spaces 44, serve as means to detect the leakage of refrigerant and/or water into spaces 44 in the system of the invention, as the tubes and annular spaces extend to a location outside of the tank. This is best seen in FIG. 4. Any break or perforation in the inner tube 40 will admit refrigerant into one or more of the spaces 44, which refrigerant will then travel to the location outside of tank 10. Similarly, any break or perforation in the outer tube 42 will admit water into 44, which will again flow to the location outside of the tank.

This type of leak detection is known. What is surprising about the spaced-apart, double wall construction of FIGS. 3 and 4 is that it can conduct as much heat from the inner tube 40 to the outer tube 42 as that of a single tube, the wall of a single tube being, of course, in intimate contact with both the heated fluid and the fluid (water) to be heated. This is accomplished by providing fins 46 with a relatively large cross section so as not to impede the flow of heat.

The tube structure of FIGS. 3 and 4 can be made by a variety of processes, the processes forming no part of the present invention.

Figure 5:
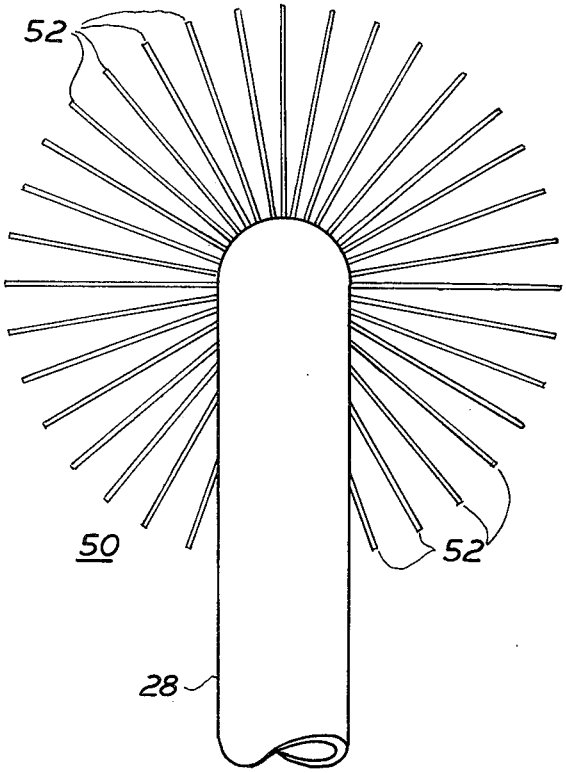
FIG. 5 is a bottom elevation view of the heat exchange unit of FIG. 2.

In the embodiment of FIG. 2 of the drawings, the heat exchange means within tank 10 is a straight, vertical, double wall tube structure 50 provided with outwardly directed fins 52 (FIG. 5) extending in the same vertical direction as tube structure 50. Tube structure 50 is otherwise the same as 16 in FIG. 1, i.e. tube structure 50 is the double wall structure 20 depicted in FIG. 3 of the drawings but having the fins 52 of FIG. 2. Similarly, like the heat exchanger 16 in FIG. 1, 50 is located in the lower portion of tank 10, though, as explained earlier, the configuration of the tank may be other than the relatively tall and narrow shape depicted in FIGS. 1 and 2.

The lower end of tube 50, like that of 16 in FIG. 1, is connected to heat source 22 (FIG. 6) via tube 28.

The operation of the system of the invention is described in terms of the schematic diagram of FIG. 6, with reference to the other figures as needed. Heat source 22 contains a refrigerant that is evaporated when the refrigerant receives heat energy and in the process the refrigerant is vaporized. In FIG. 6 of the drawings, the heated vapor is conducted via tube 20 to the upper end of heat exchanger 16 (or 50) in tank 10, which tank is substantially filled with water to be heated. Unheated, relatively cold water is supplied to the lower end of the tank via pipe 36 (FIGS. 1 and 2). In the tank, the water is in intimate contact with the fins 18 or 52 of the heat exchanger and with the outside surface of tube 42 (FIG. 3) of the heat exchanger. The refrigerant vapor is simultaneously in intimate contact with tube 40 of the heat exchanger. The refrigerant moves through tube 40 at a rate appropriate to allow the refrigerant to give up its heat to the wall of tube 40, which heat is conducted to the wall of tube 42 via fins 46 located between and in intimate contact with the tube walls. This heats the water in the tank, and in the process of giving up its heat to the water, the vapor condenses and is returned to 22. Any "slugs" of unvaporized fluid entering or forming in the heat exchanger 16 or 50 immediately fall through the inner tube 40 of the heat exchanger, under force of gravity, so that such slugs do not affect the efficiency of the heat exchange process.

The refrigerant can be directed through tube 40 of the heat exchanger 16 or 50 by normal flow of liquid due to gravity if the tank and heat exchange unit are located in a manner to gravity feed condensate from 16 or 52 to heat source 22, and the heat source is a solar collector. If the condensate from 16 or 50 cannot reach the solar collector under force of gravity, a pump 60, shown in dash outline in FIG. 6, can be used. If heat source 22 is the heat exchange device of an air conditioning or freezer unit, then a compressor 62 (in dash outline in FIG. 6) is required to direct the vapor from 22 to 16 or 50.

The unheated, relatively cold water entering into the bottom area of the tank, makes this area relatively cool with respect to the upper portion of the tank. The cold water in the vicinity of the heat exchanger 16 or 50 is, however, heated by the hot refrigerant in tube 40, and hence by the normal convection phenomenon, begins to move toward the upper portion of the tank through fins 18 or 52, i.e. in the manner in which heated air rises. The water already in the upper portion of the tank is displaced downwardly, traveling along the wall 12 of the tank remote from the heat exchanger. When this water reaches the bottom of the tank, it moves inwardly toward the heat exchanger and begins upward movement through the vertical fins 18 or 52 of the heat exchanger. This movement is not impeded by the heat exchanger, as the heat exchanger, including its fins, are disposed vertically in the tank. This, coupled with the fact that the heat of the refrigerant in tube 40 is transferred rapidly to 42 and the water about tube 42 and its fins, make the structure and process of the invention highly effective in heating and maintaining the heat of water directed to and contained in tank 10. For example, in using the refrigerant vapor produced in a five horsepower compressor of a dairy unit for cooling milk, with the vapor being at a temperature of 240° F., potable water in a 120 gallon, insulated steel tank can be maintained at approximately 120° F., with heated water being removed from the tank (via conduit 39) at a rate of 60 gallons per hour.

The system of the present invention does not require the use of sacrificial anodes in tank 10 to limit galvanic attack on the steel of the tank wall, as the dielectric, insulating properties of bushings 26, 32, 35, 37B and 40 mounted in the tank wall insulate the tank wall from metal heat exchanger 16 or 50.

In addition, the above system and construction are economical in that a standard hot water storage tank can be used, and provided with relatively inexpensive, commercially available bushings and composite (double wall) tube structures for the heat exchange units of 16 and 50.

As indicated earlier, if tank 10 is not a metallic structure, the above insulating bushings are not necessary for the prevention of galvanic action. Tanks and containers are available that are made from heat-resistant insulating materials, such as plastics and fiberglass and laminates thereof. A copper or aluminum heat exchanger in such a tank structure has no electrically opposite material with which to produce an electrolytic process when water is present in the tank.

While the invention has been described in terms of preferred embodiments, the claims appended hereto are intended to encompass all embodiments which fall within the spirit of the invention.

What is claimed is:

1. A container construction and combination including the following components and structure:

a container having a wall structure for confining water in the container, an opening provided in an upper portion of the container and wall structure, an opening provided in a lower portion of the container and wall structure, a metal heat exchanger vertically disposed within the container, the heat exchanger being comprised of inner and outer tube structures joined together in heat exchange relationship by fins extending between and in intimate contact with the tube structures, said fins having cross sections sized to conduct the heat of a refrigerant in the inner tube structure to water adjacent the outer tube structure, the outer tube structure having outwardly directed fins extending in a vertical direction within the container, and the heat exchanger having an upper and lower end within the container, means connecting the upper end of the heat exchanger in fluid communication with a source of heated refrigerant through the upper opening, the vertical disposition of the heat exchanger permitting the force of gravity to remove condensed refrigerant from the heat exchanger, means connecting the lower end of the heat exchanger to the source of heated refrigerant through the lower opening, and insulating means to free the combination of galvanic action between the components thereof when water is present in the container.

2. The combination of claim 1 in which the container is made of a heat-resistant plastic material.

3. The combination of claim 1 in which the container is a metal structure electrochemically different from the metal of the heat exchanger, and the insulating means are dielectric bushings respectively located in the openings provided in the upper and lower wall portions of the container.

4. The combination of claim 3 in which an additional opening is provided in the upper portion of the container for removing heated water from the container, and yet another opening being provided in the wall structure of the container for supplying water to the container to be heated by the refrigerant in the heat exchanger, and dielectric bushings being disposed respectively in these openings.

5. In a system for utilizing a source of heat to heat water in a tank, the system including a source of heat in which a liquid refrigerant is vaporized in the process of being heated, a tank structure provided with an opening in an upper wall portion thereof for receiving vaporized refrigerant, and an opening provided in a lower wall portion of the tank for returning condensed refrigerant to the source of heat, a second opening provided in an upper wall portion of the tank structure for removing heated water from the tank, and yet another opening provided in the structure for admitting water to be heated into the tank, metal means located within the tank structure for heating water by condensing vaporized refrigerant, said means comprising a tube structure disposed substantially vertically within the tank, and fins extending in a vertical direction within the tank, means connecting the upper end of the tube structure in fluid communication with the source of heat, said means being capable of conducting vaporized refrigerant from the source to the upper end of the tube structure, means connecting the lower end of the tube structure to the source of heat for returning refrigerant condensed in the tube structure to the source of heat, and insulating means to free the system of galvanic action when water is present in the tank.

6. The system of claim 5 in which the source of heat is a device capable of vaporizing refrigerant.

7. The system of claim 5 in which the tank structure is made of a heat-resistant plastic material.

8. The system of claim 5 in which the tank structure is metal, and the insulating means are dielectric bushings located respectively in the openings provided in the tank structure.

* * * * *